US009435323B2

(12) United States Patent
Jung et al.

(10) Patent No.: US 9,435,323 B2
(45) Date of Patent: Sep. 6, 2016

(54) PUMP FOR SUPPLYING CRYOGENIC COOLANT

(75) Inventors: Je Heon Jung, Changwon-si (KR); Jung Hyun Lee, Changwon-si (KR); Woon Sik Kwon, Changwon-si (KR); Heui Joo Park, Gimhae Si (KR); Chi Hwan Lee, Busan (KR); Yeong Chun Kim, Changwon-si (KR)

(73) Assignee: DOOSAN HEAVY INDUSTRIES & CONSTRUCTION CO., LTD., Changwon (KR)

( * ) Notice: Subject to any disclaimer, the term of this patent is extended or adjusted under 35 U.S.C. 154(b) by 415 days.

(21) Appl. No.: 12/649,939

(22) Filed: Dec. 30, 2009

(65) Prior Publication Data

US 2010/0300119 A1 Dec. 2, 2010

(30) Foreign Application Priority Data

May 29, 2009 (KR) ..... 10-2009-047612

(51) Int. Cl.

| | |
|---|---|
| ***F04B 35/04*** | (2006.01) |
| ***F04B 15/06*** | (2006.01) |
| ***F04B 19/06*** | (2006.01) |
| ***F04D 5/00*** | (2006.01) |
| ***F04D 7/02*** | (2006.01) |
| ***F04D 13/02*** | (2006.01) |

(Continued)

(52) U.S. Cl.

CPC ..... *F04B 15/06* (2013.01); *F04B 19/06* (2013.01); *F04D 5/002* (2013.01); *F04D 7/02* (2013.01); *F04D 9/003* (2013.01); *F04D 13/024* (2013.01); *F04B 37/14* (2013.01); *F04D 1/00* (2013.01); *F04D 9/001* (2013.01); *F04D 9/002* (2013.01); *F04D 27/023* (2013.01); *F04D 27/0207* (2013.01); *F04D 27/0215* (2013.01); *F04D 29/406* (2013.01)

(58) Field of Classification Search

CPC ..... F04B 15/06; F04B 19/06; F04B 37/14; F04D 5/002; F04D 9/003; F04D 29/52; F04D 29/66; F04D 7/02; F04D 5/00; F04D 5/007; F04D 29/18; F04D 29/2266; F04D 1/00; F04D 9/001; F04D 9/002; F04D 27/0207; F04D 27/0215; F04D 27/023; F04D 27/0238; F04D 29/406; F04D 29/426; F04D 29/4293; F04D 29/669; F04D 29/68; F04D 29/688; F04D 31/00; F04C 5/00

USPC ..... 62/45.1, 50.1, 50.6, 6; 417/901, 423.14, 417/423.1

See application file for complete search history.

(56) References Cited

U.S. PATENT DOCUMENTS 2,006,590 A * 7/1935 Ferguson ..... F04D 5/002 415/55.1
2,583,572 A * 1/1952 Huber ..... 418/56

(Continued)

*Primary Examiner* — Frantz Jules
*Assistant Examiner* — Webeshet Mengesha
(74) *Attorney, Agent, or Firm* — Sughrue Mion, PLLC

(57) ABSTRACT

A pump for supplying a cryogenic liquid coolant in accordance with the present invention includes: a housing having an inlet port for introducing a cryogenic liquid coolant, an outlet port for discharging the cryogenic liquid coolant introduced through the inlet port, and a chamber for connecting the inlet port and the outlet port; an impeller rotatably retained in the housing for introducing the cryogenic liquid coolant through the inlet port and discharging the same through the outlet port; and a vapor exhausting part provided in the housing for exhausting vapor generated from the cryogenic liquid coolant.

4 Claims, 6 Drawing Sheets

(51) Int. Cl.

| | |
|---|---|
| *F04D 27/02* | (2006.01) |
| *F04D 9/00* | (2006.01) |
| *F04D 29/40* | (2006.01) |
| *F04D 1/00* | (2006.01) |
| *F04B 37/14* | (2006.01) |

(56) References Cited

U.S. PATENT DOCUMENTS 3,734,638 A * 5/1973 Ebsary ..... 415/141
4,565,498 A * 1/1986 Schmid ..... F04C 29/122 417/68
4,591,311 A * 5/1986 Matsuda ..... F04D 5/002 415/55.5
4,593,835 A * 6/1986 Kikkawa et al. ..... 222/131
4,981,413 A * 1/1991 Elonen ..... F04D 7/045 415/115
6,488,468 B1 * 12/2002 Danielsson et al. ..... 415/126
7,632,060 B2 * 12/2009 Yu ..... 415/55.1
2006/0280631 A1 * 12/2006 Tsai et al. ..... 417/423.1

* cited by examiner

PUMP FOR SUPPLYING CRYOGENIC COOLANT

BACKGROUND OF THE INVENTION

1. Field of the Invention

The present invention relates to a pump for supplying a cryogenic liquid coolant, and more particularly to a pump for supplying a cryogenic liquid coolant capable of maintaining an outlet port side pressure in a stable manner by exhausting vapor generated within the pump through vent holes when supplying the cryogenic liquid coolant.

2. Description of the Prior Art

As generally known in the art, a cryogenic liquid coolant is provided to a superconducting motor or generator or the like through a supply pump, while maintaining as close to a cryogenic state as possible. At this moment, since the cryogenic liquid coolant (referred to as "coolant" hereinafter) is in a state just before boiling, it has characteristics to be easily evaporated by a small temperature difference or the like during its supply process.

However, such a pump for supplying the coolant is considerably vulnerable to vapor or gas. If the gas ratio within the pump is more than about 5-10% during the supply process of the coolant, both the suction and discharge pressures by an impeller are rapidly reduced, so that the coolant may not be discharged.

In general, the coolant is introduced into an inlet port by the rotation of the impeller, and the coolant, after entering the inlet port, passes through a chamber to be discharged to an outlet port. At this moment, a portion of the coolant is evaporated to generate vapor by the temperature difference or the like within the chamber. The vapor, as shown in FIG. 1, serves as a factor to make an outlet port pressure unstable. As such, when the outlet port pressure becomes unstable, the suction and discharge operation of the coolant is not performed in a stable manner, and further a considerably big noise is generated. If such circumstances become much worse, the pumping operation should be stopped, or the pump might be damaged.

Particularly, as shown in FIG. 2, if the rotational speed of the impeller increases over a certain speed, the pressure at the outlet port cannot increase anymore due to the vapor of the coolant. This is attributed to uneven suction and discharge operations by the impeller due to the vapor, which is partially re-circulated to the inlet port by the impeller reducing the suction pressure. The vapor re-circulated to the inlet port increases as the rotational speed of the impeller increases. Consequently, as shown in FIG. 2, it can be noted that the outlet port side pressure cannot increase further over the certain rotational speed of the impeller, and the cryogenic liquid coolant cannot be properly supplied.

SUMMARY OF THE INVENTION

Accordingly, the present invention has been made to solve the above-mentioned problems occurring in the prior art, and an object of the present invention is to provide a pump for supplying a cryogenic liquid coolant which can maintain an outlet port side pressure in a stable manner by exhausting vapor generated within the pump though vent holes when supplying the cryogenic liquid coolant.

Another object of the present invention is to provide a pump for supplying a cryogenic liquid coolant in which the outlet port side pressure can be increased according to the rotational speed of an impeller by preventing the vapor from being re-circulated to an inlet port when the pump is operated at high speed.

In order to accomplish these objects, there is provided a pump for supplying a cryogenic liquid coolant, including: a housing having an inlet port for introducing a cryogenic liquid coolant; an outlet port for discharging the cryogenic liquid coolant introduced through the inlet port; and a chamber for connecting the inlet port and the outlet port; an impeller rotatably retained in the housing for introducing the cryogenic liquid coolant through the inlet port and discharging the same through the outlet port; and a vapor exhausting part provided in the housing for exhausting vapor generated from the cryogenic liquid coolant.

In accordance with an exemplary embodiment of the present invention, the steam exhausting part includes a first vent hole formed at a front surface of the housing for connecting the chamber with an outside of the housing, and a second vent hole formed at an outer surface of the housing to connect the chamber with the outside of the housing.

The second vent hole is formed at a location adjacent to the inlet port of the housing.

Meanwhile, the above mentioned object can be also accomplished by a pump for supplying a cryogenic liquid coolant of the present invention, which includes: a housing having an inlet port for introducing a cryogenic liquid coolant; an outlet port for discharging the cryogenic liquid coolant introduced through the inlet port; and a chamber for connecting the inlet port and the outlet port; an impeller rotatably retained in the housing for introducing the cryogenic liquid coolant through the inlet port and discharging the same through the outlet port; and a vent hole formed at an outer surface of the housing for connecting the chamber with an outside of the housing so as to exhaust vapor generated from the cryogenic liquid coolant to the outside of the housing through the chamber.

The vent hole is formed at a location adjacent to the inlet port closer than the outlet port of the housing.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
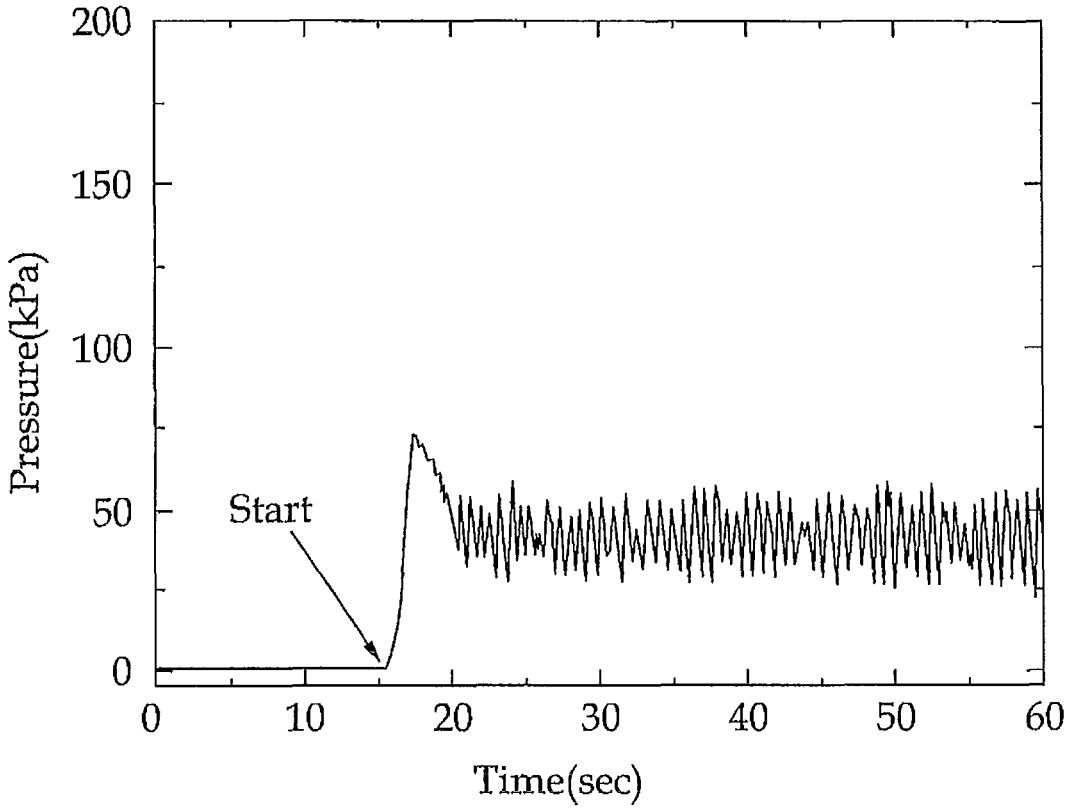
FIG. 1 PRIOR ART
FIG. 1 is a graph illustrating pressure changes at an outlet port side of a pump for supplying a cryogenic liquid coolant in the prior art.
Figure 2:
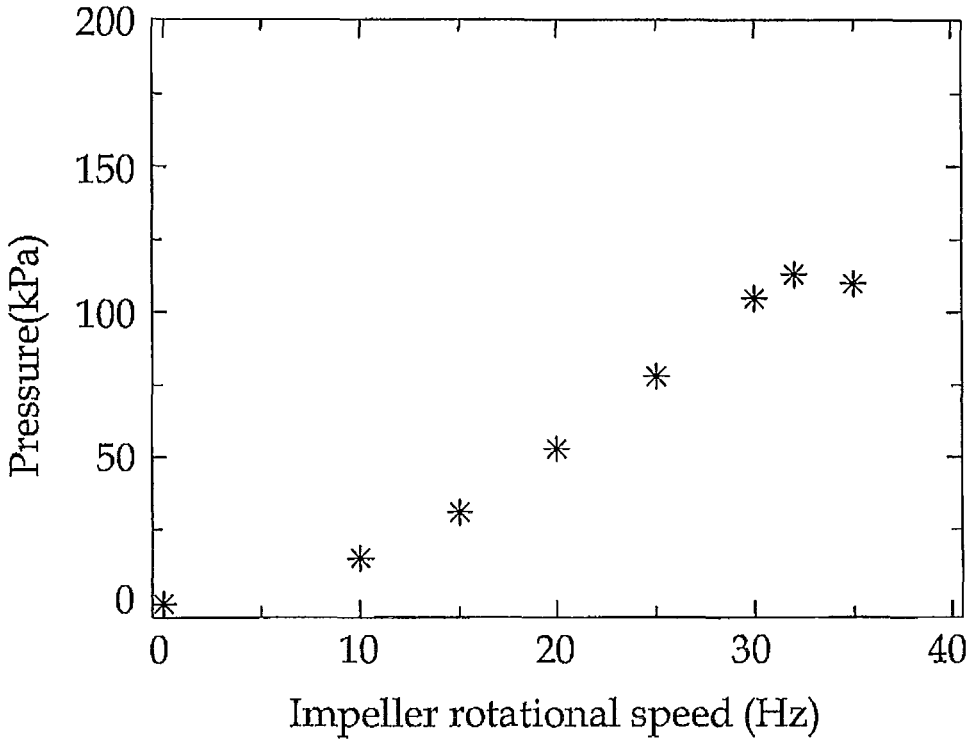
FIG. 2 PRIOR ART
FIG. 2 is a graph illustrating pressure changes at the outlet port side with respect to a rotational speed of an impeller of the pump for supplying the cryogenic liquid coolant in the prior art.

Hereinafter, an exemplary embodiment of the present invention will be described with reference to the accompanying drawings. In the following description and drawings, the same reference numerals are used to designate the same or similar components, and so repetition of the description on the same or similar components will be omitted.

Figure 3:
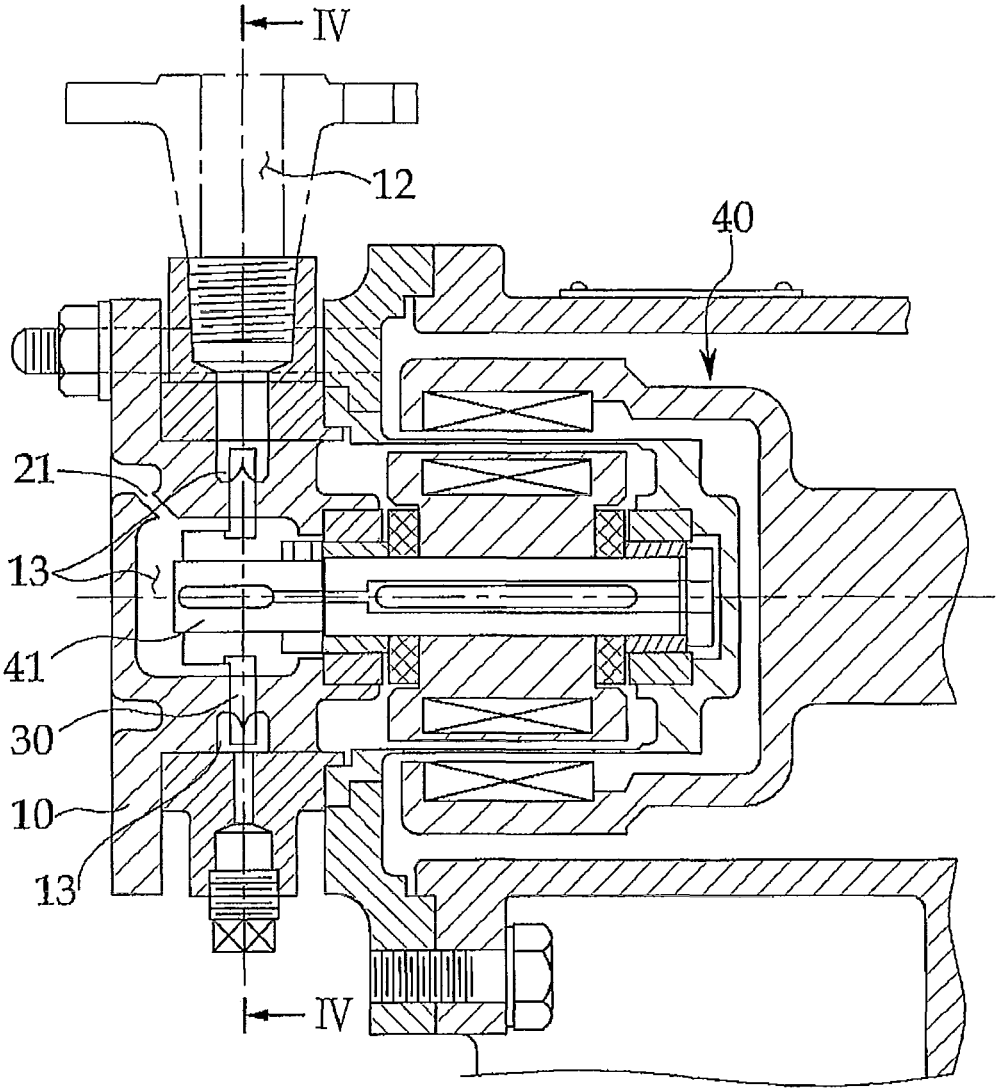
FIG. 3 is a schematic cross-sectional view of a pump for supplying a cryogenic liquid coolant in accordance with an exemplary embodiment of the present invention.
Figure 4:
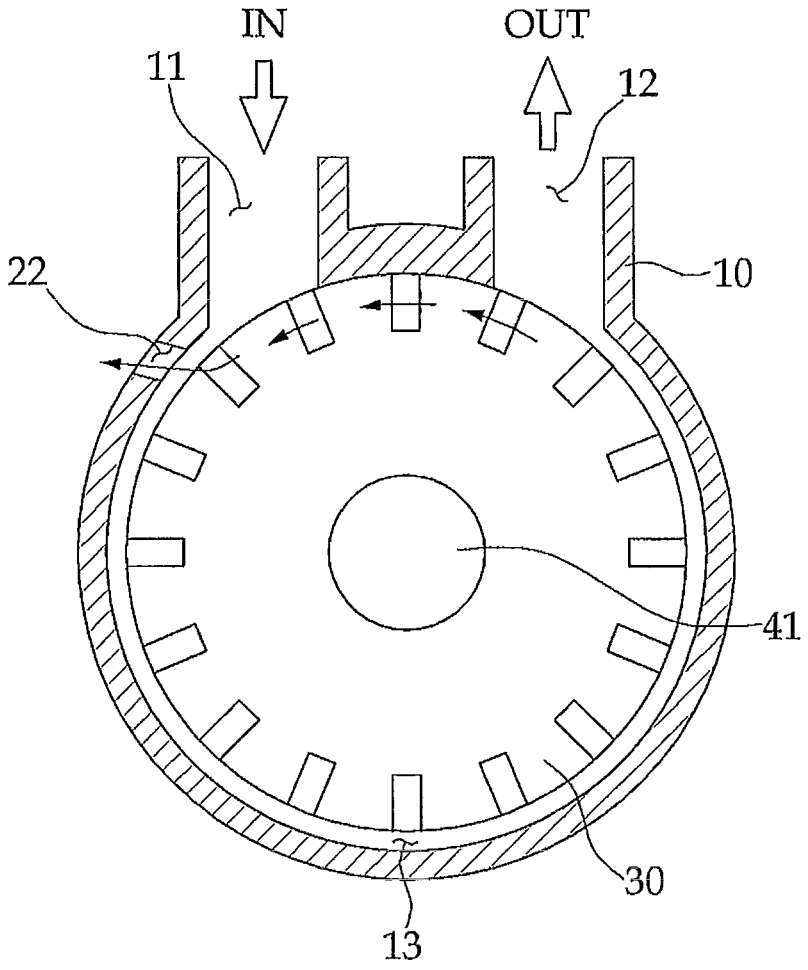
FIG. 4 is a cross-sectional view taken along line IV-IV in FIG. 3.

Referring to FIGS. 3 and 4, a pump for supplying a cryogenic liquid coolant in accordance with an exemplary embodiment of the present invention is designed to supply the cryogenic liquid coolant ("coolant") to a superconducting motor or generator or the like. The pump includes a housing 10 having an inlet port 11 for introducing a coolant, an outlet port 12 for discharging the coolant introduced through the inlet port 11, and a chamber 13 for connecting the inlet port 11 and the outlet port 12; an impeller 30 rotatably retained in the housing 10 for introducing the coolant through the inlet port 11 and discharging the same through the outlet port 12; and steam exhausting parts 21 and 22 provided in the housing 10 for exhausting vapor generated from the coolant.

The impeller 30 is rotatably installed in the housing 10, and connected to a driving shaft 41 of a driving part 40 to be rotated. The driving part 40 is a magnetic coupling for embodying itself in a non-contact manner, which is connected to a driving motor (not shown).

The vapor exhausting parts, as shown in FIG. 3, include a first vent hole 21 (refer to FIG. 3) formed at the front surface of the housing 10, and a second vent hole 22 (refer to FIG. 4) formed at the outer surface of the housing 10.

The first vent hole 21 extends from the chamber 13 to the front surface of the housing 10, and exhausts the vapor in the chamber 13 to the outside of the housing 10. With the first vent hole 21, it can be noted that the vapor which is generated by the temperature change in the pump or during the supply of the coolant can be exhausted to the outside of the housing 10. More specifically, the coolant is introduced from the inlet port 11 by the impeller 30 being rotated in the chamber 13 of the housing 10, passed through the chamber 13, and then exhausted through the outlet port 12. During such processes, a small amount of the coolant is evaporated to generate steam by the temperature change of the coolant within the chamber 13 or by provision of the liquid coolant. At this moment, such vapor is exhausted to the outside through the first vent hole 21 formed in the housing 10.

Meanwhile, when the vapor in the chamber 13 is exhausted through the first vent hole 21, it includes a small amount of the coolant itself therein, which leads to some loss of the coolant. However, since the exhausted amount of the coolant, i.e., loss of the coolant as described above is negligible, it may not substantially affect the amount of the coolant to be supplied.

Figure 5:
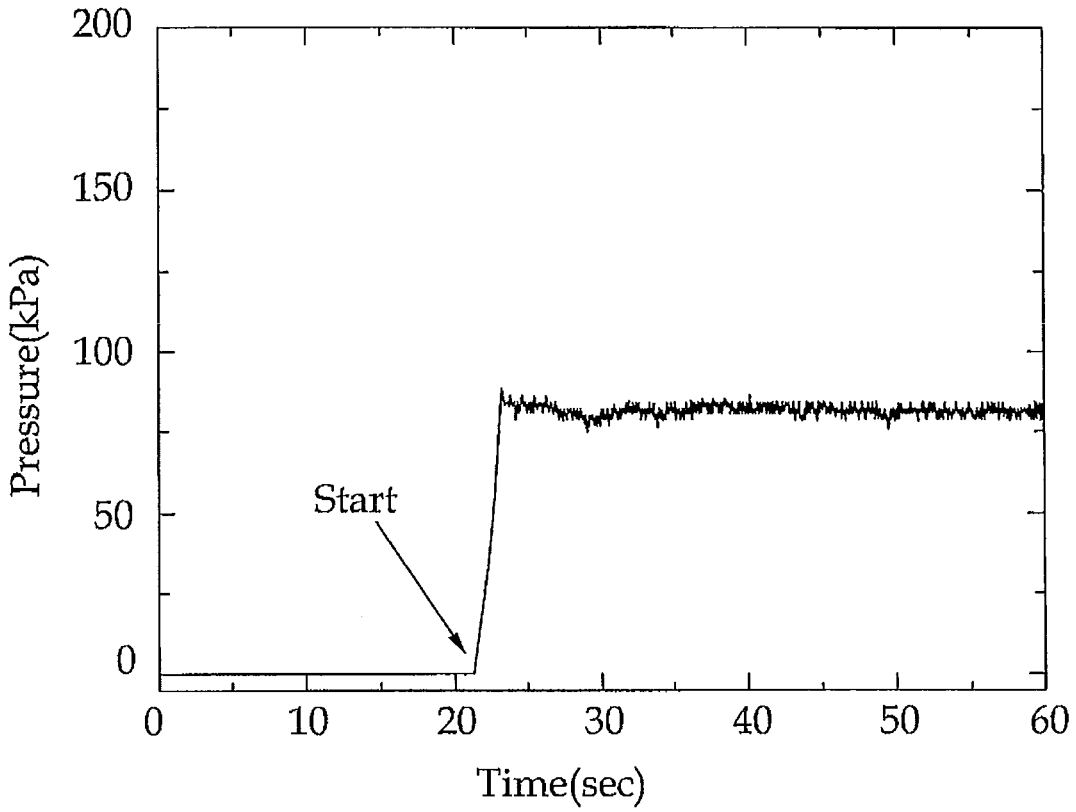
FIG. 5 is a graph schematically illustrating pressure changes at an outlet port side of the pump for supplying the cryogenic liquid coolant as shown in FIG. 3.

With the inventive pump having configurations as described above, it can minimize a rapid pressure fluctuation generated at the outlet port side due to the vapor in the prior art, which allows the pump to be operated in a smooth manner. In order to prove this situation, an experiment was performed using a cryogenic liquid coolant at −196° C. to measure the pressure at the outlet port 12, the results of which shows that the pumping operation is stably performed as shown in FIG. 5.

Hence, it can be noted that a small amount of the vapor generated within the chamber 13 of the housing 10 during the supply of the coolant can be exhausted in a smooth manner. Accordingly, the pumping operation is stably performed, which makes it possible to enhance the reliability of the pump and supply the coolant in a smooth manner.

Further, since the first vent hole 21 is formed at the front surface of the housing 10, the vapor in the chamber 13 may be more efficiently exhausted.

In contrast, the second vent hole 22 extends from the chamber 13 to the outer surface of the housing 10, and exhausts the vapor in the chamber 13 to the outside of the housing 10.

Particularly, the second vent hole 22 is formed at a location adjacent to the inlet port 11, more specifically a location of the inlet port 11 opposite to the direction of the outlet port 12. The reason for this is to exhaust the vapor which is re-circulated to the inlet port 11 when the rotational speed of the impeller 30 increases over a predetermined speed.

As described above, when the pump is operated at high speed to supply the coolant, there is a phenomenon that the vapor of the coolant within the pump is re-circulated to the inlet port 11. In other words, while the coolant introduced through the inlet port 11 is circulated at high speed in the chamber 13 and exhausted through the outlet port 12, a portion of the coolant and the vapor of the same are circulated back to the inlet port 11, which collide with the coolant being introduced into the inlet port 11, called a re-circulation phenomenon, thereby making the pumping operation unstable.

According to the present invention, however, it should be appreciated that a portion of the coolant, which is re-circulated to the inlet port 11 while the pump is rotated at high speed, and the vapor from the coolant can be exhausted to the outside through the second vent hole 22, thereby preventing a phenomenon that the pressure at the outlet port is not increased beyond a predetermined value due to the re-circulation of the vapor.

Figure 6:
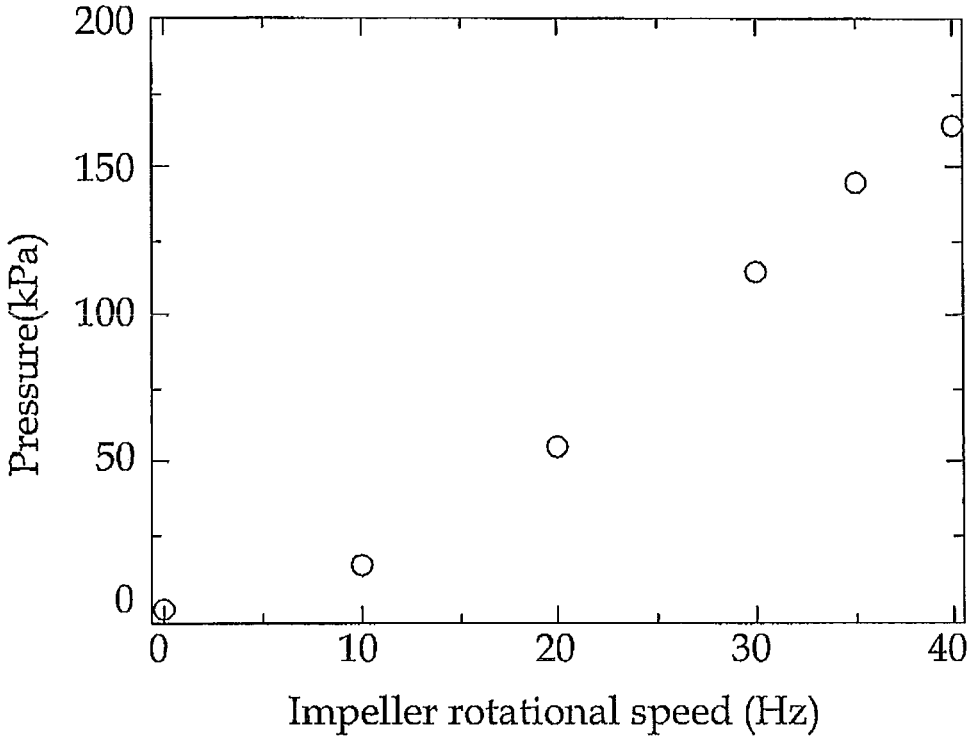
FIG. 6 is a graph schematically illustrating pressure changes at the outlet port side with respect to a rotational speed of an impeller of the pump for supplying the cryogenic liquid coolant as shown in FIG. 3.

Hence, the pressure at the outlet port 12 can be smoothly increased by means of the second vent hole 22 which is formed at the side of the inlet port 11 to be communicated with the outside. Such an effect is confirmed through an experiment as shown in FIG. 6. Referring to FIG. 6, when the impeller 30 is rotated at a low speed, there is no substantial difference from the pump without the second vent hole 22. However, when the impeller 30 is rotated at high speed beyond a predetermined speed, the pressure at the outlet port 12 can be smoothly increased, thereby allowing the pump to be operated in a stable manner.

Accordingly, since the unstable factors in the pumping operation due to the re-circulation phenomenon during the high speed operation thereof are resolved through the second vent hole 22 formed at the side of the inlet port 11, the pump can be operated in a stable manner, thereby improving both its reliability and the supply capability of the coolant.

As described above, the vapor generated within the pump when supplying the cryogenic liquid coolant can be forcibly exhausted to the outside through the first vent hole 21 or the second vent hole 22, so the pressure at the outlet port 12 can be maintained in a stable manner. Therefore, it can be noted that the pumping operation of the cryogenic liquid coolant is stably performed, so as to improve the reliability of the pump as well as supply the cryogenic liquid coolant in a smooth manner.

In addition, since the first vent hole 21 is located at the front surface of the housing 10, the operation of the vapor exhaustion can be performed more efficiently by the rotating impeller 30.

Furthermore, it can be noted that the second vent hole 22 can prevent the re-circulation phenomenon of the vapor generated from the cryogenic liquid coolant when the pump is operated at high speed, which makes it possible to supply the cryogenic liquid coolant in a stable manner and improve the reliability of the pump.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A pump for supplying a cryogenic liquid coolant, comprising:

a housing having an inlet port for introducing a cryogenic liquid coolant, an outlet port for discharging the cryogenic liquid coolant and being next to the inlet port, and a chamber for connecting the inlet port and the outlet port, the inlet port and the outlet port being provided at an upper portion of the housing;

an impeller rotatably retained in the housing for introducing the cryogenic liquid coolant through the inlet port and discharging the same through the outlet port; and a vapor exhausting part provided in the housing for exhausting vapor generated from the cryogenic liquid coolant, wherein the vapor exhausting part includes a first vent hole formed at the front surface of the housing so as to connect the chamber with the outside of the housing, wherein the vapor exhausting part includes a second vent hole formed at the outer surface of the housing through the housing sidewall so as to connect the chamber with the outside of the housing, wherein the second vent hole is formed on the outer surface of the housing which encloses the impeller in the direction of rotation and at the upper portion of the housing, and wherein the inlet port, the second vent hole and the outlet port are provided sequentially along the rotational direction of the impeller;

wherein the second vent hole is formed at a location adjacent to the inlet port of the housing, such that vapor re-circulated to the inlet port is exhausted through the second vent hole when the rotational speed of the impeller increases over a predetermined speed;

the location of the second vent hole is downstream from the inlet port and upstream from the outlet port with respect to the flow of the cryogenic liquid coolant, the second vent port and outlet port being provided, and spaced apart from each other, at opposing sides of the inlet port;

the second vent hole being configured to be open to the outside of the housing while the pump is operating.

2. The pump for supplying a cryogenic liquid coolant according to claim 1, wherein the inlet port and the second vent hole are located on a same plane, the same plain being a plane that is perpendicular to the axis of rotation of the impeller.

3. The pump for supplying a cryogenic liquid coolant according to claim 1, wherein the inlet port, the outlet port and the second vent hole are located on a same plane, the same plane being a plane that is perpendicular to the axis of rotation of the impeller.

4. The pump for supplying a cryogenic liquid coolant according to claim 1, wherein the impeller, the inlet port, the outlet port, and the second vent hole are located on a same plane, the same plane being a plane that is perpendicular to the axis of rotation of the impeller.

* * * * *